US005711548A

United States Patent [19]

Hendler et al.

[11] Patent Number: 5,711,548

[45] Date of Patent: Jan. 27, 1998

[54] METHOD AND MEANS FOR PROVIDING A PERSONAL MEMORY CALENDAR CONVERTIBLE TO A PERMANENT MEMORY BOOK

[76] Inventors: Judith Hendler; Geoffrey Cathers, both of 1018 S. Stanley Ave., Los Angeles, Calif. 90019

[21] Appl. No.: 647,061

[22] Filed: May 9, 1996

[51] Int. Cl.[6] ..... B42D 15/00

[52] U.S. Cl. ..... 283/67; 283/2

[58] Field of Search ..... 283/2, 3, 4, 67, 283/70; 412/1

[56] References Cited

U.S. PATENT DOCUMENTS 4,798,402 1/1989 Pazicni ..... 283/4

4,902,042 2/1990 Rassi ..... 283/2

5,016,917 5/1991 Dubner et al. ..... 283/4

5,062,229 11/1991 Werjefelt ..... 283/2

*Primary Examiner*—Willmon Fridie, Jr.

*Attorney, Agent, or Firm*—Lawrence S. Cohen

[57] ABSTRACT

A calendar has a personal display portion and a monthly calendar portion from which a memory book is created at the end of the year. Each personal display portion is a graphics image such as a picture of personal interest. The calendar pages are bound along an edge of the personal display portion, so that by removing the monthly calendar portion there remains a book of the twelve personal graphics or pictures. This book is then bound in a binder for permanent preservation and presentation.

8 Claims, 2 Drawing Sheets

METHOD AND MEANS FOR PROVIDING A PERSONAL MEMORY CALENDAR CONVERTIBLE TO A PERMANENT MEMORY BOOK

FIELD OF THE INVENTION

This invention relates to calendars of the type which have a display portion and to personal picture collections in bound form.

BACKGROUND

It is known that calendars have monthly pages which have a graphic display portion, usually at the top and a monthly calendar portion usually at the bottom. These are bound at a top edge so that as each month ends, that page can be turned to expose the next page.

It is also known that personal pictures can be bound into books.

SUMMARY OF THE INVENTION

In the method of the invention a calendar is provided having a separate page for each month. One portion of the page, preferably the upper portion has a personal graphic display such as a picture. Another portion, preferably the lower portion of each page has the monthly calendar for that page. The pages are bound on an edge of the personal graphic display portion, preferably the top. It is preferable to have a front and a back cover sheet as well. When the year is over, the monthly calendar portions are removed (they can be removed at any time once the month is over) leaving a book of the personal graphics pages. Then the book is put into a permanent binder. The permanent binder can be made in a number of ways to facilitate assembly with the personal graphics pages. The personal graphic display are preferably photographs or mixed media such as photographs and text of personal relevance which are copied onto the monthly page. A preferred binder has a front and back pocket on the inside of each cover. The pocket receives the cover sheets, thus holding the book inside the binder. Other means for holding the book inside the binder can be used.

DETAILED DESCRIPTION

Figure 1:
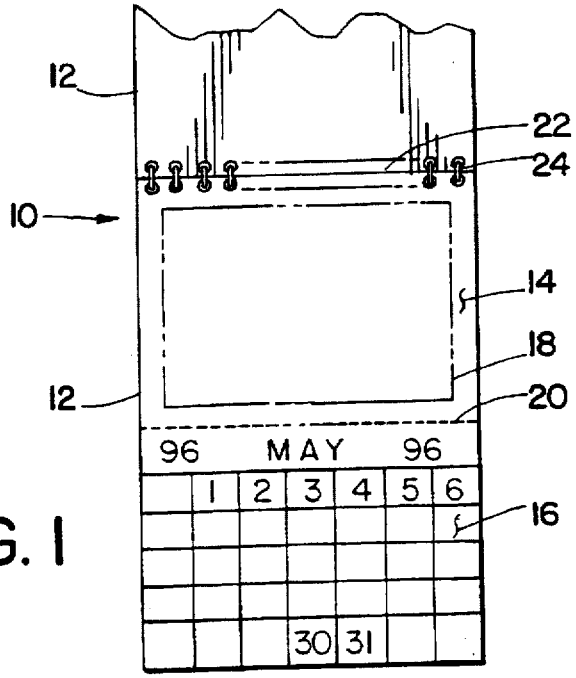
FIG. 1 shows the calendar as prepared with each page having a monthly calendar portion and a personal graphics display portion.

Referring to FIG. 1 there is shown calendar 10 which has a calendar page 12, the one shown being arbitrarily designated as May 1996. Each calendar page 12 has an upper portion 14 which is a personal graphics portion and a lower portion 16 which is a monthly calendar portion. The personal graphics portion will have printed on it a personal graphic 18 such as a picture or a combination of a picture and text or other graphics. A separation line 20 is provided to enable uniform separation on each page. The separation line 20 may be perforated, for added convenience. A binding means is in place along the top edge of the page 22, being an edge adjacent the personal graphics portion. A common type of wire binder 24 is shown. Thus there are typically twelve pages one for each month of the year.

The calendar pages can be made in a number of ways. An inventory of the pages, in annual sets could be prepared in advance, having the monthly calendar printed on each of the 12 pages with the personal graphics portions blank. Then the 12 selected personal graphics can be printed on each of the 12 pages. Alternatively the personal graphics portion can be printed simultaneously with printing of the monthly calendar portion. Present technology allows considerable flexibility in the creativity allowed for creation of the personal graphics portion as well as the normal calendar portion.

Figure 2:
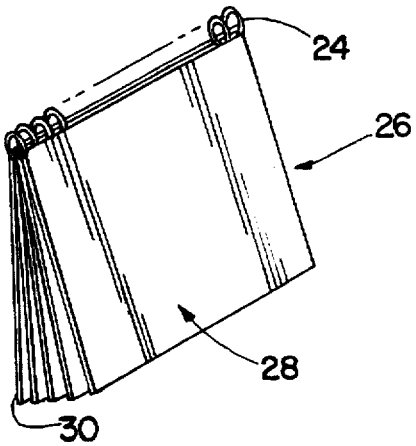
FIG. 2 shows the book of personal graphics book made from the calendar of FIG. 1, after the monthly calendar portions has been removed.

FIG. 2 shows the personal graphics book 26 each page having the selected personal graphics printed on it, formed after all the monthly calendar portions have been removed. The personal graphics book 26 now has only the personal graphics portions from each monthly page. Preferably, also there is a front cover sheet 28 and a back cover sheet 30. Selected indicia can be printed on the front cover sheet 28.

Advances in color photocopying and desktop publishing now make it economically convenient to have prepared a personal calendar from a selection of graphics such as photographs. Creativity can be exercised by the person producing the calendar.

Figure 3:
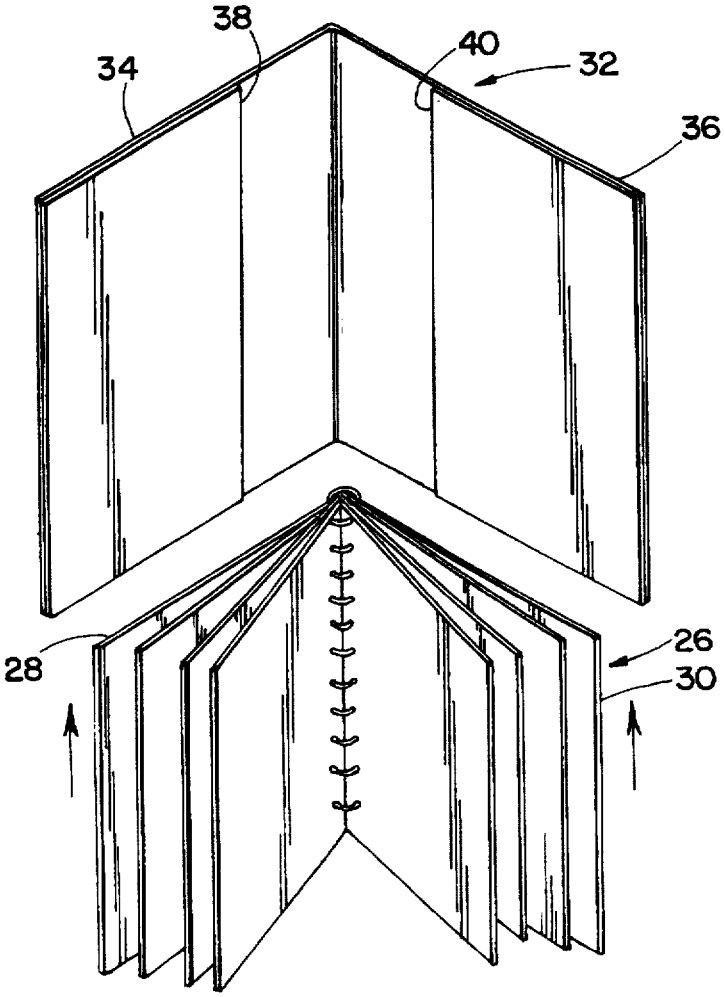
FIG. 3 shows a view of the memory book binder and the personal graphics book separately ready for assembly.

FIG. 3 shows the personal graphics book 26 as it would be ready for assembly to a binder 32 having front cover 34 and back cover 36. The front cover 34 and back cover 36 each have a pocket 38 and 40 respectively into which the cover sheets 28 and 30 will be inserted. The cover sheets 28 and 30 are preferably made of a stiffer material than the pages of the book to enable the assembly to stay firmly together.

Figure 4:
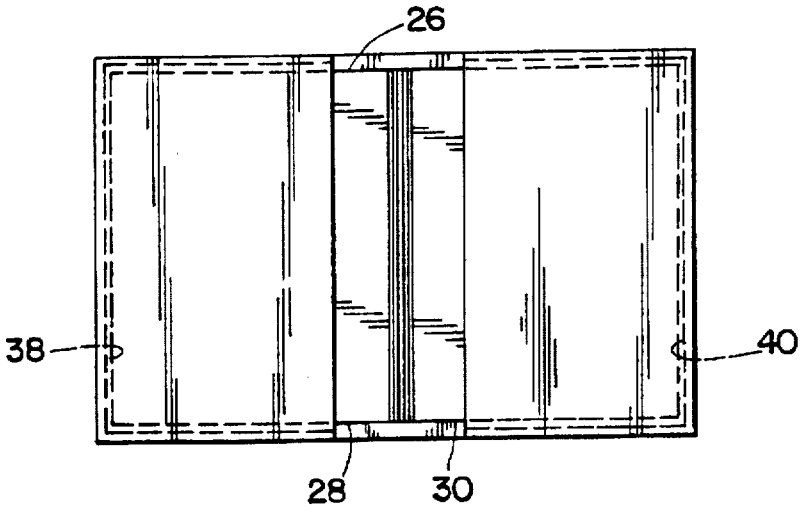
FIG. 4 shows the personal graphics book installed in the memory book binder.

FIG. 4 shows the personal graphics book 26 in place within the binder 32 by having the cover sheets 28 and 30 in the pockets 38 and 40 respectively with the pages between them.

Thus with this assembly there is formed a memory book for the year past, while the graphics in the book have been enjoyed during the year, one month at a time.

Figure 5:
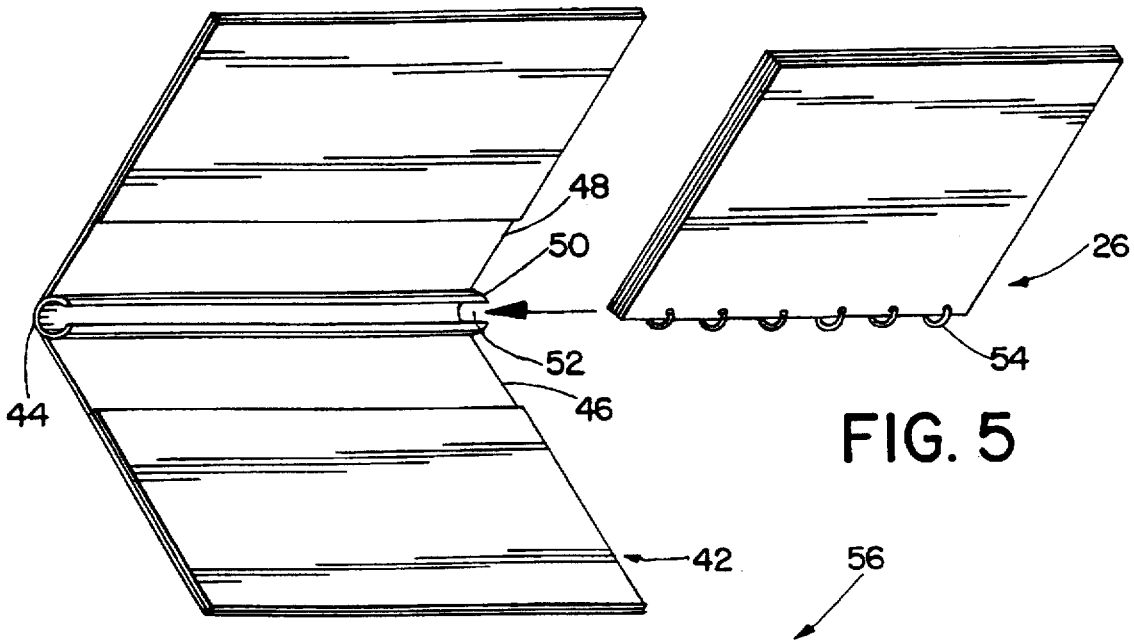
FIG. 5 shows an alternative construction of the memory book binder and the personal graphics book ready for assembly.

FIG. 5 shows an alternative embodiment of the binder, and method of assembly. In this case the binder 42 has a spine portion 44 and covers 46 and 48. Adhered to the inside of the spine portion is a slit tube 50. The tube 50 is preferably made of plastic and slit or having a portion removed to create an opening 52. In the assembly process the personal graphics book 26 is moved longitudedly of the tube so that its binding means 54 enters the tube and is retained therein. The resilient biasing of the tube holds the personal graphics book 26 in place.

Figure 6:
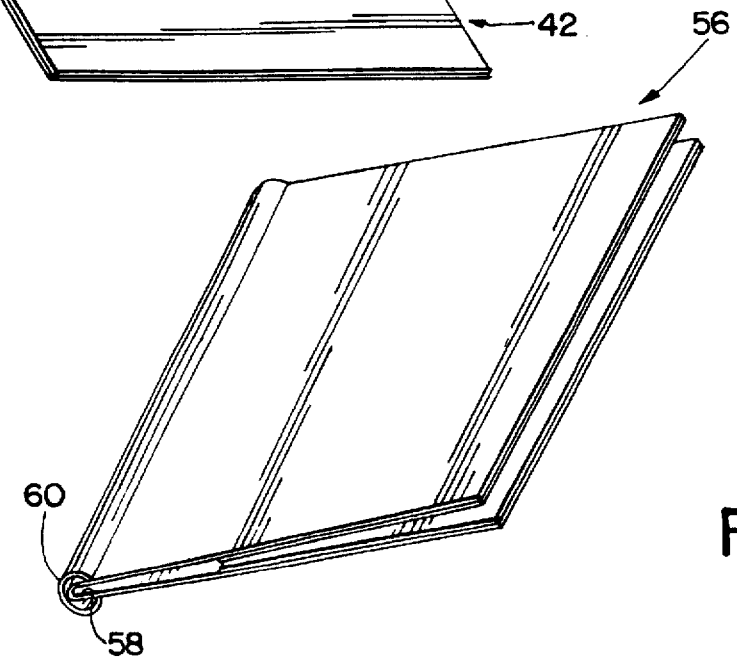
FIG. 6 shows another alternative construction of the memory book cover for use with the personal graphics book.

FIG. 6 shows an alternative embodiment of a binder 56 in which a spine portion 58 is captured inside a resilient biasing tube 60.

In the method of the invention the personal graphics are selected or otherwise prepared. This would typically be photographs, but other items can be used including objects, mixed media and the like which can be reproduced. One item is prepared for each of the 12 months. Then the graphics objects are reproduced on the personal graphics portion of each page of the calendar. The monthly calendar is also printed on the page, and the whole collection is bound into an annual calendar with the typical wire binder at the top permitting the pages to be turned sequentially. At the end of the year (or of each month as desired) the monthly calendar portions are removed, leaving only the personal graphics book. The personal graphics book is then inserted into the binder completing the annual memory book. Identifying indicia can be place on the front cover of the binder.

Although particular embodiments of the invention have been described and illustrated herein, it is recognized that modifications and variations may readily occur to those skilled in the art, and consequently it is intended that the claims be interpreted to cover such modifications and equivalents.

What is claimed is:

1. A method of creating a personal memory book comprising;

providing a calendar having a page for each month, each of said pages having a blank personal display portion and a monthly calendar portion, providing a set of selected items of graphic material and designating one of said selected items of graphic material for each of the said blank personal display portions;

printing on each of said blank personal display portions the item of graphic material designated for it;

binding said pages at an edge of each of said pages adjacent said personal display portion;

removing from said pages said monthly calendar portions to provide a remaining collection comprising said personal display portions being bound together;

retaining said collection of personal display portions in a binder.

2. The method of claim 1 further comprising providing a front and a back cover sheet on said annual calendar, and providing a pocket interiorly on each of front and back cover portions of said binder and placing said front and back cover sheets respectively in said pockets.

3. The method of claim 1 further comprising providing means for retaining said personal graphics portions in the binder.

4. A method of creating a personal memory book comprising;

selecting a collection of objects to be copied as personal graphics copies;

providing a plurality of pages each having a monthly calendar portion and a blank personal graphics portions;

binding said plurality of pages;

copying one of the collection of objects on each of the blank personal graphics portion of each of said pages to provide a personal graphics copy on each of said pages;

copying a monthly calendar for each of the months of the year respectively on the pages on the monthly calendar portion to provide a complete annual calendar having a page for each month and each page having a selected one of said personal graphics copies and a monthly calendar.

5. The method of claim 4 wherein said pages have a lower portion having said monthly calendar thereon and an upper portion having said personal graphic thereon said binding is along a top edge adjacent said personal graphic.

6. The method of claim 4 further comprising removing the monthly calendar portions, leaving only the bound personal graphics portions.

7. The method of claim 4 further comprising providing a binder and placing the personal graphics portions in the binder.

8. A method of creating a calendar which is convertible to a customer's personal memory book comprising;

obtaining from a customer source a set of customer-personal graphics items to be copied as personal graphics, each one of said set having been designated by the customer for a particular month of the calendar;

preparing a plurality of pages each having a blank personal graphics display portion and a printed calendar month on an adjacent calendar month portion;

printing on each page at the blank personal display portion a copy of the customer-personal graphics item which has been designated for the month printed on that page;

binding said plurality of pages at an edge of said pages adjacent said personal display portion;

rendering along a line between said personal display portion and said calendar month portion a weakening for removal of said calendar month portion thereby permitting leaving as each calendar month portion is removed the personal graphics portions bound together.

* * * * *